US010463090B2

(12) United States Patent
Morin et al.

(10) Patent No.: US 10,463,090 B2
(45) Date of Patent: Nov. 5, 2019

(54) ARM PROTECTOR OR OTHER BODY PART PROTECTOR

(71) Applicant: BAUER PERFORMANCE LACROSSE INC., Liverpool, NY (US)

(72) Inventors: Kyle Morin, Rye, NH (US); Eric Lemieux, St-Sauveur (CA)

(73) Assignee: BAUER HOCKEY, LLC, Exeter, NH (US)

( * ) Notice: Subject to any disclaimer, the term of this patent is extended or adjusted under 35 U.S.C. 154(b) by 157 days.

(21) Appl. No.: 14/220,465

(22) Filed: Mar. 20, 2014

(65) Prior Publication Data

US 2015/0264987 A1 Sep. 24, 2015

(51) Int. Cl.

| | |
|---|---|
| ***A41D 13/00*** | (2006.01) |
| ***A41D 13/08*** | (2006.01) |
| ***A63B 71/12*** | (2006.01) |
| ***A41D 13/05*** | (2006.01) |
| *A63B 102/24* | (2015.01) |
| *A63B 102/14* | (2015.01) |

(52) U.S. Cl.

CPC ..... *A41D 13/08* (2013.01); *A41D 13/0568* (2013.01); *A63B 71/12* (2013.01); *A63B 71/1225* (2013.01); *A63B 2071/1258* (2013.01); *A63B 2102/14* (2015.10); *A63B 2102/24* (2015.10); *A63B 2243/0025* (2013.01)

(58) Field of Classification Search

CPC .. A41D 13/015; A41D 13/0543; A41D 13/05; A41D 13/065; A41D 13/0153; A41D 13/0156; A41D 13/06; A41D 13/08; A41D 13/0562; A41D 13/0002; A41D 13/00; A41D 13/0015; A41D 13/0556; A41D 13/0568; A63B 71/1225; A63B 71/12; A63B 71/143; A63B 71/14; A63B 71/08

USPC ..... 2/16, 455, 22, 59, 267; 602/53, 60, 62, 602/63, 75, 78

See application file for complete search history.

(56) References Cited

U.S. PATENT DOCUMENTS 4,120,052 A * 10/1978 Butler ..... 2/16
4,888,826 A * 12/1989 Parsons, Jr. ..... A63B 71/1225 2/22
5,168,576 A * 12/1992 Krent ..... A41D 13/0156 2/16
5,255,391 A * 10/1993 Levine ..... A41D 13/0568 2/24
5,472,413 A * 12/1995 Detty ..... A61F 5/0104 2/16
5,511,243 A * 4/1996 Hall et al. ..... 2/16
(Continued)

OTHER PUBLICATIONS

Examiner's report dated Jul. 7, 2015 in connection with Canadian Patent Application 2,852,886, 5 pages.

*Primary Examiner* — Khaled Annis

(57) ABSTRACT

A protector for protecting an arm or other body part of a wearer, such as a sports player playing lacrosse, hockey, baseball, or another sport. The protector comprises: a base for engaging the wearer's arm or other body part; and a pad member fastened to the base and comprising protective padding. The pad member may be fastened to the base by a narrow fastening zone. This may allow the protector to better fit on the wearer's arm or other body part, reduce resistance to movement of the wearer's arm or other body part, and/or increase breathability or ventilation of the wearer's arm or other body part and the protector itself.

32 Claims, 8 Drawing Sheets

(56) References Cited

U.S. PATENT DOCUMENTS

| | | | | |
|---|---|---|---|---|
| 5,537,689 | A * | 7/1996 | Dancyger | A41D 13/065 2/24 |
| 5,608,912 | A * | 3/1997 | Cumberland | 2/16 |
| 5,642,525 | A * | 7/1997 | Ketola | 2/16 |
| 5,769,808 | A * | 6/1998 | Matthijs et al. | 602/64 |
| 5,946,737 | A * | 9/1999 | Fleege | A41D 13/06 2/16 |
| 6,098,208 | A * | 8/2000 | Cordon | A63B 71/08 2/16 |
| 6,178,556 | B1 * | 1/2001 | Foreman | A63B 71/08 128/882 |
| 6,205,583 | B1 * | 3/2001 | Beland | 2/16 |
| 2003/0154540 | A1 * | 8/2003 | Nishimoto | A63B 71/1225 2/220 |
| 2005/0108800 | A1 * | 5/2005 | White | 2/2.5 |
| 2006/0107433 | A1 * | 5/2006 | Olson | A61F 5/0104 2/22 |
| 2007/0234460 | A1 * | 10/2007 | Castonguay et al. | 2/16 |
| 2009/0077703 | A1 * | 3/2009 | Gabry et al. | 2/16 |
| 2009/0126066 | A1 * | 5/2009 | Sasaki | A41D 13/065 2/24 |
| 2010/0192269 | A1 * | 8/2010 | Saranga | A41D 13/065 2/24 |
| 2010/0306908 | A1 | 12/2010 | Fiegener et al. | |
| 2010/0319096 | A1 * | 12/2010 | Scott et al. | 2/16 |

* cited by examiner

ARM PROTECTOR OR OTHER BODY PART PROTECTOR

FIELD OF THE INVENTION

The invention relates generally to protective equipment wearable by wearers such as individuals engaging in sports (e.g., lacrosse, hockey, baseball, etc.).

BACKGROUND

Protective equipment, such as arm protectors, leg protectors, shoulder pads, etc., is used by wearers engaging in various sports (e.g., lacrosse, hockey, baseball, football, etc.) and other activities. In order to be effective, a wearer's protective equipment provides protection against impacts or other types of contact that could otherwise hurt or injure the wearer. In addition, it is often desirable for the protective equipment to not be cumbersome or otherwise impede motion of the wearer or discomfort the wearer.

For example, a lacrosse, hockey or other sports player typically wears arm protectors, leg protectors, and/or shoulder pads to protect himself/herself from impacts with a stick or other implement, a puck, ball or other object, and/or other players during play, but it is usually desirable for the player to remain as mobile and comfortable as possible. This can present challenges in terms of design of the protective equipment. For instance, to protect joints of the player, which move significantly, it is usually useful for the protective equipment to minimize resistance to motion of the player's joints while at the same time providing adequate protection to the player's joints.

For these and other reasons, there is a need for improvements in protective equipment wearable by sports players and other individuals.

SUMMARY OF THE INVENTION

According to an aspect of the invention, there is provided an arm protector for protecting an arm of a wearer. The arm protector comprises: a base for engaging the wearer's arm; and a pad member fastened to the base and comprising protective padding. The pad member is fastened to the base by a fastening zone which spans less than half of a length of the pad member.

According to another aspect of the invention, there is provided an arm protector for protecting an arm of a wearer. The arm protector comprises: a base for engaging the wearer's arm; and a pad member fastened to the base and comprising protective padding. The pad member includes a lateral portion movable relative to the base. The lateral portion of the pad member extends from a longitudinal end of the pad member and corresponds to at least one-third of a length of the pad member.

According to another aspect of the invention, there is provided an arm protector for protecting an arm of a wearer. The arm protector comprises: a base for engaging the wearer's arm; and a pad member fastened to the base and comprising protective padding. The pad member is fastened to the base such that, when the arm protector is worn on the wearer's arm, a first longitudinal end and a second longitudinal end of the pad member are movable adjacent to one another.

According to another aspect of the invention, there is provided an arm protector for protecting an arm of a wearer. The arm protector comprises: a sleeve mountable about the wearer's arm; and a pad member stitched to the sleeve and comprising protective padding. The pad member is stitched to the sleeve by stitching spanning less than one-quarter of a length of the pad member.

According to another aspect of the invention, there is provided a protector for protecting a limb of a wearer. The protector comprises: a base for engaging the wearer's limb; and a pad member fastened to the base and comprising protective padding. The pad member is fastened to the base by a fastening zone which spans less than half of a length of the pad member.

According to another aspect of the invention, there is provided a protector for protecting a limb of a wearer. The protector comprises: a base for engaging the wearer's limb; and a pad member fastened to the base and comprising protective padding. The pad member includes a lateral portion movable relative to the base. The lateral portion of the pad member extends from a longitudinal end of the pad member and corresponds to at least one-third of a length of the pad member.

According to another aspect of the invention, there is provided a protector for protecting a limb of a wearer. The protector comprises: a base for engaging the wearer's limb; and a pad member fastened to the base and comprising protective padding. The pad member is fastened to the base such that, when the protector is worn on the wearer's limb, a first longitudinal end and a second longitudinal end of the pad member are movable adjacent to one another.

According to another aspect of the invention, there is provided a protector for protecting a body part of a wearer. The protector comprises: a base for engaging the wearer's body part; and a pad member fastened to the base and comprising protective padding. The pad member is fastened to the base by a fastening zone which spans less than half of a length of the pad member.

According to another aspect of the invention, there is provided a protector for protecting a body part of a wearer. The protector comprises: a base for engaging the wearer's body part; and a pad member fastened to the base and comprising protective padding. The pad member includes a lateral portion movable relative to the base. The lateral portion of the pad member extends from a longitudinal end of the pad member and corresponds to at least one-third of a length of the pad member.

According to another aspect of the invention, there is provided a protector for protecting a body part of a wearer. The protector comprises: a base for engaging the wearer's body part; and a pad member fastened to the base and comprising protective padding. The pad member is fastened to the base such that, when the protector is worn on the wearer's body part, a first longitudinal end and a second longitudinal end of the pad member are movable adjacent to one another.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
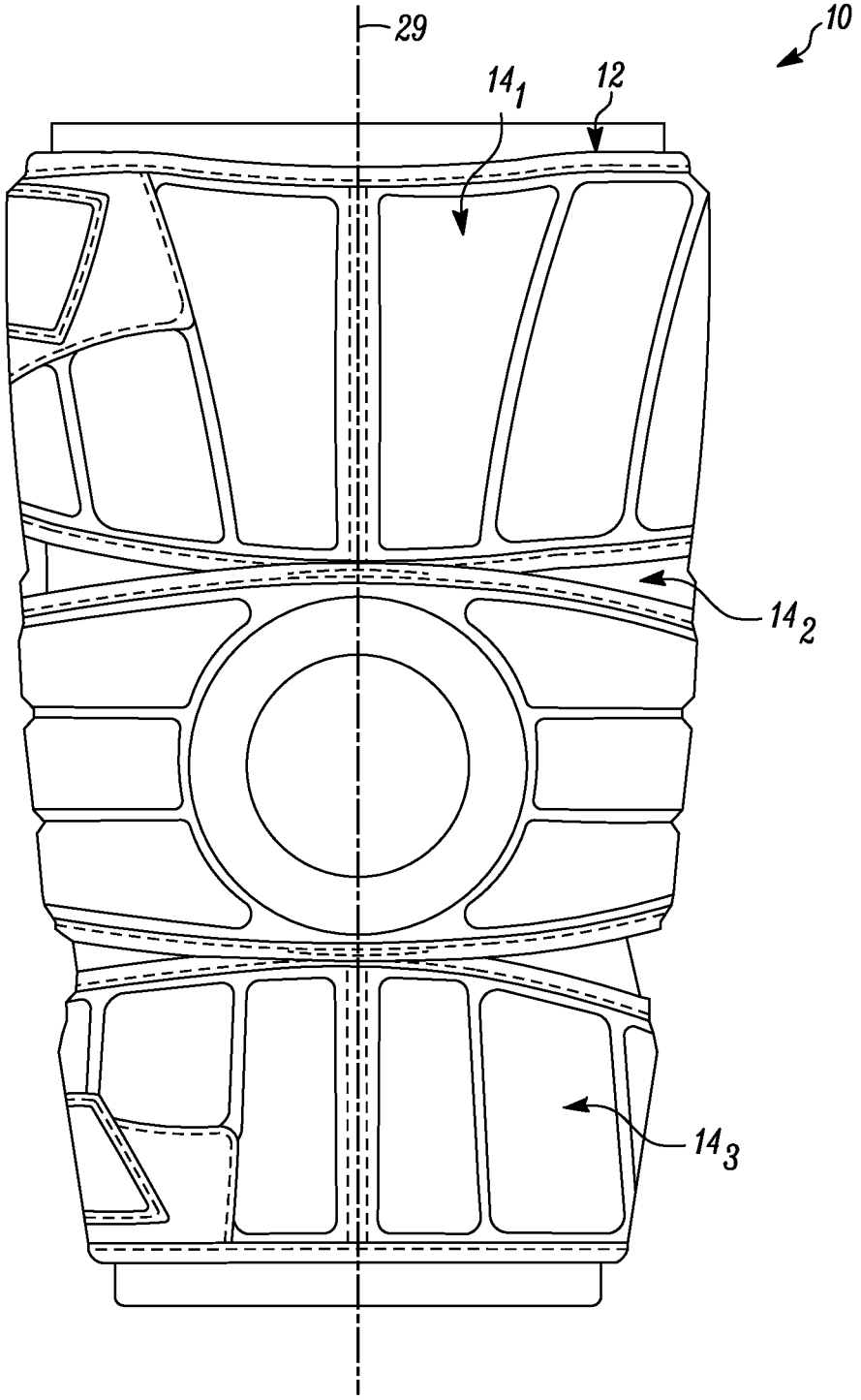
FIG. 1 shows a front view of an example of a protector for protecting a body part of a wearer in accordance with an embodiment of the invention.
Figure 2:
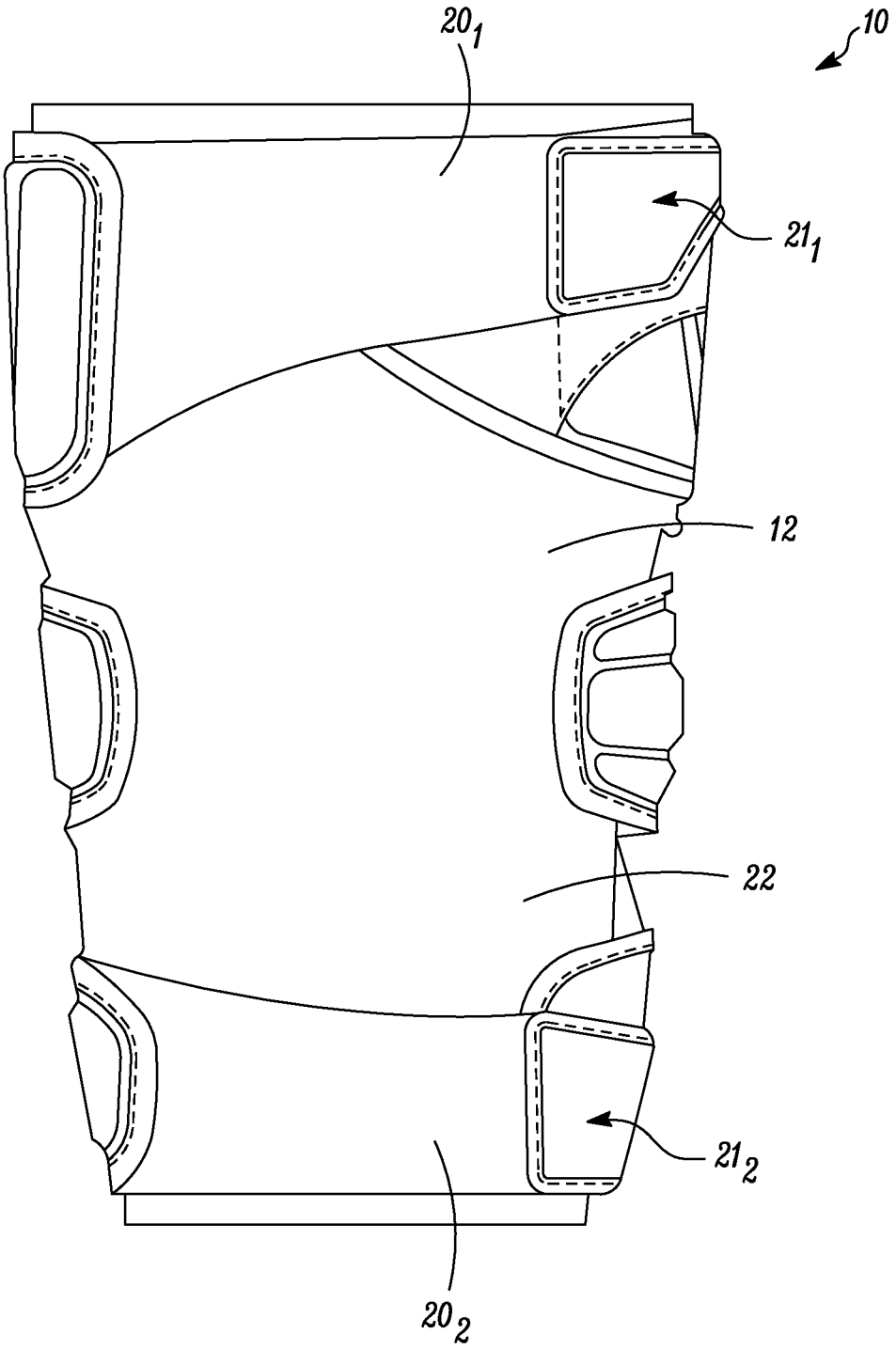
FIG. 2 shows a back view of the protector.

FIGS. 1 and 2 show an example of a protector 10 wearable on a body part of a wearer for protecting the wearer's body part in accordance with an embodiment of the invention. In this embodiment, the protector 10 is a limb protector for protecting a limb of the wearer. More specifically, in this embodiment, the protector 10 is an arm protector for protecting an arm of the wearer. In this example, the arm protector 10 is an athletic protector wearable by the wearer who is engaging in a sport. More particularly, in this example, the arm protector 10 is a lacrosse arm protector and the wearer is a lacrosse player playing lacrosse.

The arm protector 10 is configured to protect the player's arm (i.e., provide protection to at least part of the player's arm). In this embodiment, the arm protector 10 provides protection to an upper arm (e.g., bicep) region, a lower (e.g., forearm) region, and an elbow region of the player's arm. In this example, the arm protector 10 may be referred to as an "arm guard" or "arm pad".

In this embodiment, the arm protector 10 comprises a base 12 for engaging the player's arm and a plurality of pad members $\mathbf{14}_1$-$\mathbf{14}_3$ fastened to the base 12. The arm protector 10 also comprises a plurality of straps $\mathbf{20}_1$, $\mathbf{20}_2$ extending from respective ones of the pad members $\mathbf{14}_1$, $\mathbf{14}_3$. As further discussed later, the arm protector 10 may be configured to provide a better fit on the player's arm, less resistance to bending of the player's arm, and/or improved breathability or ventilation of the player's arm and the arm protector 10 itself.

The base 12 engages the player's arm when the arm protector 10 is worn. In this embodiment, the base 12 comprises a sleeve 22 mountable about the player's arm.

Figure 5:
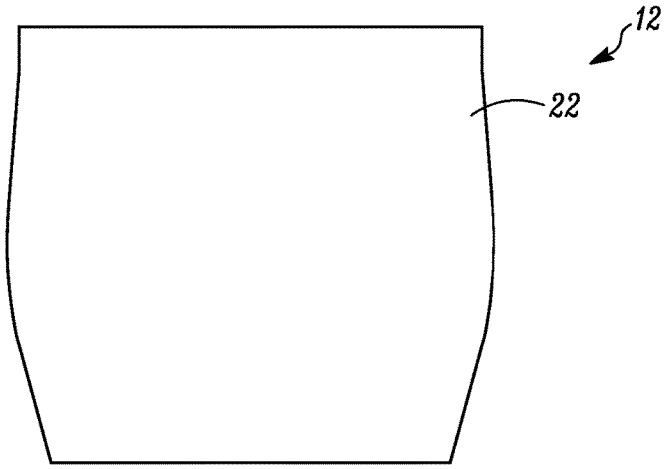
FIG. 5 shows a plan view of a base of the protector in an unfolded state.

In this embodiment, the sleeve 22 is configured to fit the player's arm snuggly. More particularly, in this embodiment, the sleeve 22 has a generally cylindrical shape which is implemented by stitching or otherwise affixing (e.g., by an adhesive, ultrasonic welding, etc.) opposite end portions of the sleeve 22 to one another. An unfolded view of the sleeve 22 is shown in FIG. 5. Also, in this embodiment, the sleeve 22 comprises a stretchable material in order to fit the player's arm snuggly. For instance, the sleeve 22 may stretch and close back onto the player's arm when the player's arm is inserted in it (e.g., providing a slight "compression fit"). In this embodiment, the stretchable material of the sleeve 22 is a stretchable fabric (e.g., a woven fabric, a nonwoven fabric, or any other suitable fabric). In this case, the stretchable fabric of the sleeve 22 is a spandex fabric. In other embodiments, the stretchable fabric of the sleeve 22 may comprise a polyester and spandex blend, nylon, or any other suitable material. In some cases, the sleeve 22 may have a hydrophobic property in order to repel moisture (e.g., sweat) away from the player's arm.

The base 12 may be implemented in various other ways in other embodiments. For example, in other embodiments, the base 12 may comprise a plurality of sleeves similar to the sleeve 22, such as an upper sleeve and a lower sleeve, which are interconnected. As another example, in other embodiments, the base 12 may comprise a structure that engages the player's arm without wrapping about the player's arm when the arm protector 10 is worn (e.g., a liner contacting the player's arm only on one, two, or three sides of the player's arm, but not wrapping around the player's arm).

The pad members $\mathbf{14}_1$-$\mathbf{14}_3$ protect various regions of the player's arm. In this embodiment, the pad member $\mathbf{14}_1$ is an upper pad member for positioning above an elbow of the player's arm to protect an upper arm (e.g., bicep) region of the player's arm, the pad member $\mathbf{14}_2$ is an intermediate pad member for positioning over the elbow of the player's arm to protect an elbow region of the player's arm, and the pad member $\mathbf{14}_3$ is a lower pad member for positioning below the elbow of the wearer's arm to protect a lower (e.g., forearm) region of the player's arm.

Figure 4A:
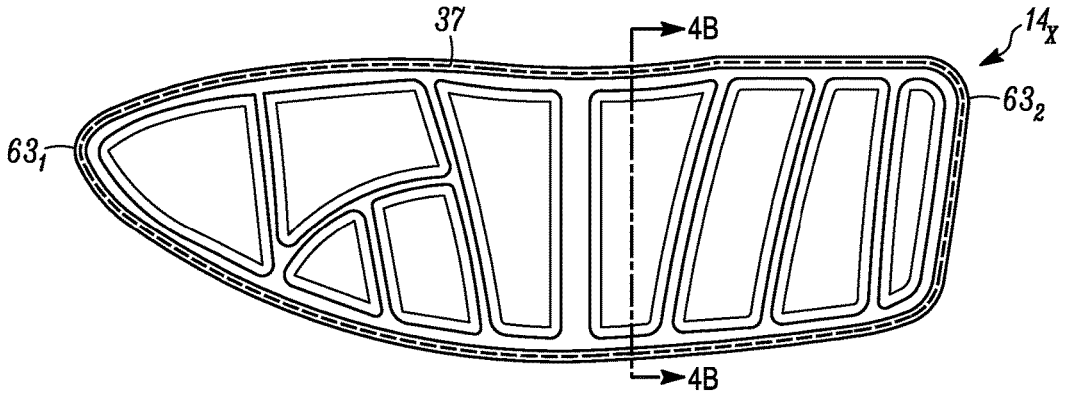
FIG. 4A shows a front view of a pad member of the protector.
Figure 4B:
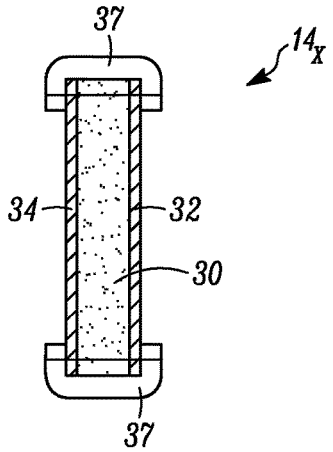
FIG. 4B shows a cross-sectional view of the pad member.

Each pad member $\mathbf{14}_x$ of the pad members $\mathbf{14}_1$-$\mathbf{14}_3$ provides padded protection to the wearer's arm. To that end, with additional reference to FIG. 4B, the pad member $\mathbf{14}_x$ comprises protective padding 30. The protective padding 30 comprises a shock-absorbing material. For example, in this embodiment, the shock-absorbing material of the protective padding 30 comprises foam. For instance, in some examples of implementation, the foam may be ethylene vinyl acetate (EVA) foam, expanded polypropylene (EPP) foam, expanded polyethylene (EPE) foam (e.g., low-density polyethylene (LDPE) foam), vinyl nitrile (VN) foam, polyurethane foam, or any other suitable foam. In other embodiments, the shock-absorbing material of the protective padding 30 may comprise any other shock-absorbing substance other than foam (e.g., a gel).

In addition to the protective padding 30, in this embodiment, the pad member $\mathbf{14}_x$ comprises an outer covering 32 and an inner lining 34 between which the protective padding 30 is disposed. The inner lining 34 faces towards the player's arm, while the outer covering 32 faces away from the player's arm. In this example of implementation, the inner lining 34 is operable to contact the base 12. In this case, the inner lining 34 comprises fabric. For instance, the fabric of the inner lining 34 may comprise a woven fabric, a nonwoven fabric, or any other suitable fabric. Also, in this example of implementation, the outer covering 32 may be exposed to more wear since it is operable to endure impacts in use. In this case, the outer covering 32 comprises flexible non-foam polymeric material. For instance, in some examples, the flexible non-foam polymeric material of the outer covering 32 may comprise polyurethane. In addition, in this embodiment, the pad member $\mathbf{14}_x$ comprises a band 37 extending around a periphery of the pad member $\mathbf{14}_x$ to retain (e.g., clamp) together the inner lining 34, the protective padding 30, and the outer covering 32. The band 37 may comprise any suitable material and may be secured to the outer covering 32, the inner lining 34, and/or the protective padding 30 in any suitable way. In this example, the band 37 is comprises a fabric (e.g., spandex, nylon or any other suitable fabric) and is clamped about and stitched to the outer covering 32, the inner lining 34, and the protective padding 30.

In this embodiment, the pad member $\mathbf{14}_x$ is flexible such that it can bend about the player's arm when the arm protector 10 is worn. More particularly, in this example, when the player's arm is inserted into the sleeve 22 and the straps $\mathbf{20}_1$, $\mathbf{20}_2$ are wrapped about the player's arm, the pad member $\mathbf{14}_x$ bends and folds about the player's arm.

Figure 3:
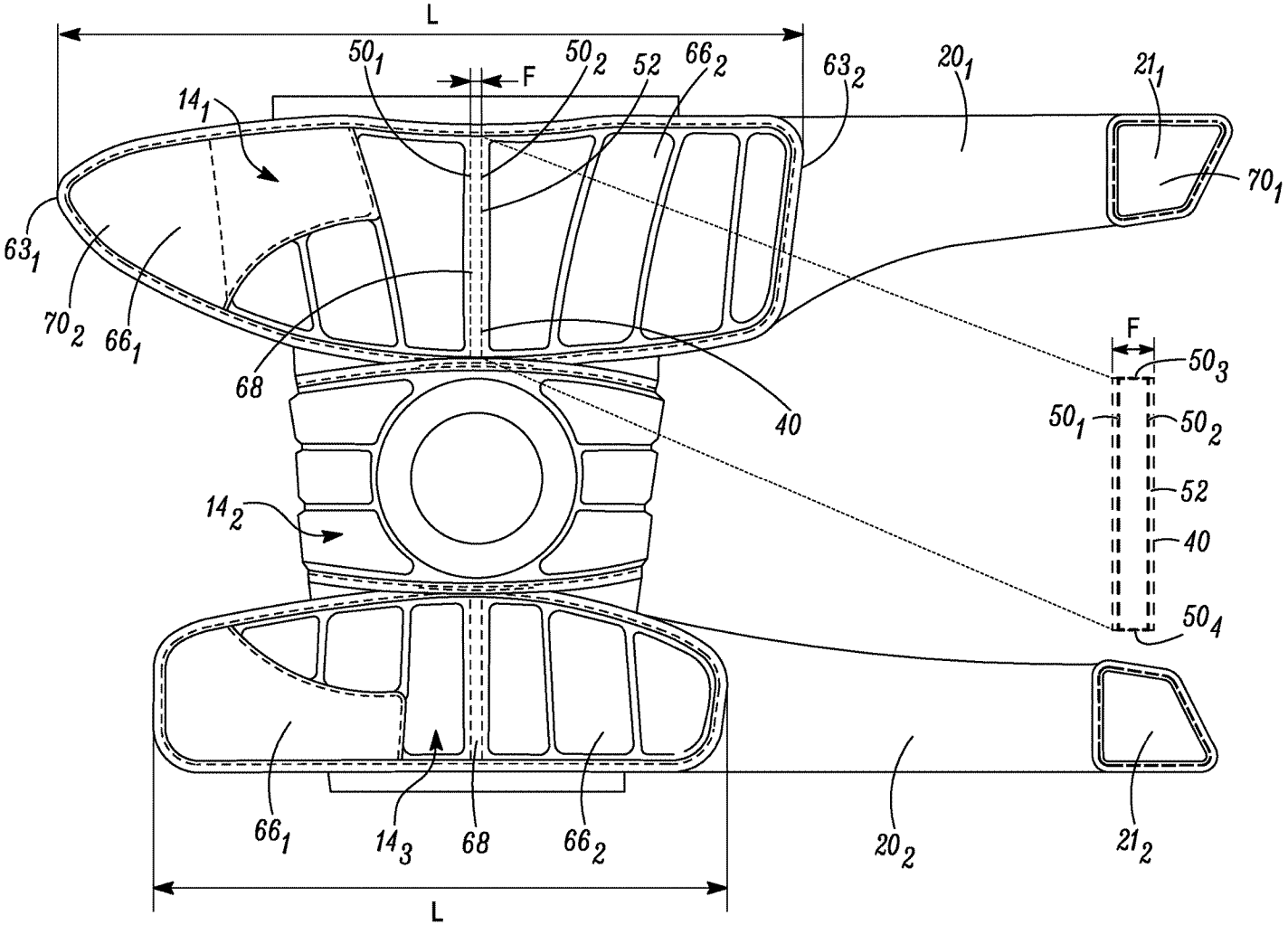
FIG. 3 shows a front view of the protector in which straps of the protector are in an open position.

As shown in FIG. 3, the pad member $\mathbf{14}_x$ has longitudinal ends $\mathbf{63}_1$, $\mathbf{63}_2$ that define a length L of the pad member $\mathbf{14}_x$. In this embodiment, the pad member $\mathbf{14}_x$ is elongated and mounted to the base 12 such that its length L is oriented transversally to a longitudinal axis 29 of the arm protector 10.

Each of the pad members $\mathbf{14}_1$-$\mathbf{14}_3$ may be implemented in various other ways in other embodiments. For example, in some embodiments, each of the pad members $\mathbf{14}_1$-$\mathbf{14}_3$ may comprise any other suitable material (e.g., a rigid material such that the outer covering 32 is a rigid shell) and/or may have any other suitable shape.

Each pad member $\mathbf{14}_x$ of the pad members $\mathbf{14}_1$-$\mathbf{14}_3$ is fastened to the base 12 by a fastening zone 40. The fastening zone 40 of the pad member $\mathbf{14}_x$ is that zone which encompasses every fastener fastening the pad member $\mathbf{14}_x$ to the base 12. Thus, one or more fasteners fasten the pad member $\mathbf{14}_x$ to the base 12 and the fastening zone 40 encompasses the one or more fasteners fastening the pad member $\mathbf{14}_x$ to the base 12, i.e., spans between extremities of the one or more fasteners fastening the pad member $\mathbf{14}_x$ to the base 12. As such, the fastening zone 40 may be viewed as having a dimension F spanning between extremities of the one or more fasteners fastening the pad member $\mathbf{14}_x$ to the base 12.

Figure 7:
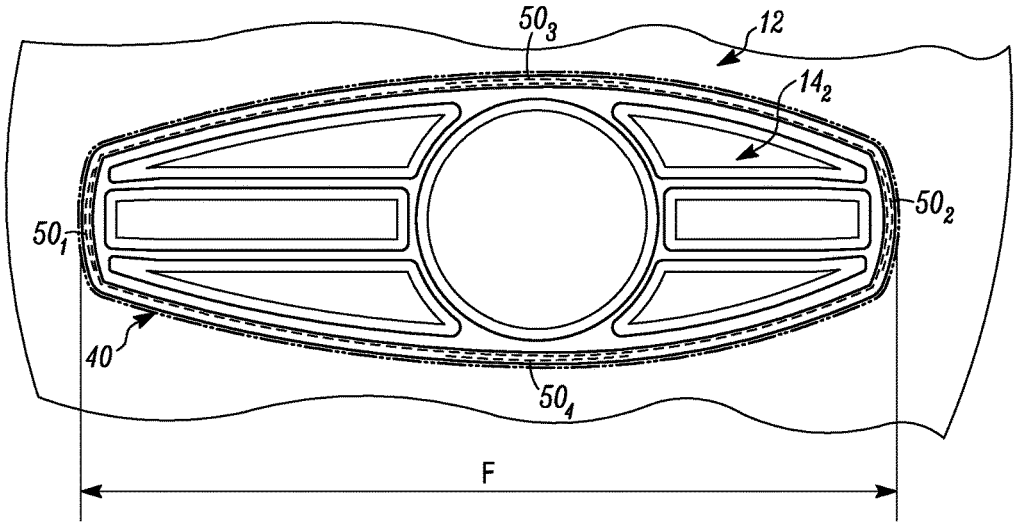
FIG. 7 shows a plan view of another pad member of the protector fastened to the base in an unfolded state.

For example, in this embodiment, each pad member $\mathbf{14}_y$ of the upper and lower pad members $\mathbf{14}_1$, $\mathbf{14}_3$ is fastened to the base 12 by a plurality of fasteners $\mathbf{50}_1$-$\mathbf{50}_4$. In this example, each of the fasteners $\mathbf{50}_1$-$\mathbf{50}_4$ comprises a stitching 52. More particularly, in this example, the stitching 52 is a stitch line (i.e., a line of stitches). Each of the fasteners $\mathbf{50}_1$-$\mathbf{50}_4$ may be any other suitable fastener in other embodiments (e.g., any other mechanical fastener such as a tack, a rivet, a button, a screw, etc., or an adhesive). The fastening zone 40 of the pad member $\mathbf{14}_y$ encompasses the fasteners $\mathbf{50}_1$-$\mathbf{50}_4$, i.e., spans between extremities of the fasteners $\mathbf{50}_1$-$\mathbf{50}_4$. The dimension F of the fastening zone 40 of the pad member $\mathbf{14}_y$, which in this case is a width of the fastening zone 40, thus spans between extremities of the fasteners $\mathbf{50}_1$, $\mathbf{50}_2$. In this example, the fasteners $\mathbf{50}_1$-$\mathbf{50}_4$ are arranged in a generally rectangular or "box-like" configuration. The fasteners $\mathbf{50}_1$-$\mathbf{50}_4$ may be arranged in any other configuration in other examples. Similarly, in this embodiment, as shown in FIG. 7, the intermediate pad member $\mathbf{14}_2$ is fastened to the base 12 by a plurality of fasteners $\mathbf{50}_1$-$\mathbf{50}_4$ such that the fastening zone 40 of the intermediate pad member $\mathbf{14}_y$ encompasses the fasteners $\mathbf{50}_1$-$\mathbf{50}_4$, i.e., spans between extremities of the fasteners $\mathbf{50}_1$-$\mathbf{50}_4$.

Each of the pad members $\mathbf{14}_1$-$\mathbf{14}_3$ is movable relative to the base 12. Notably, in this embodiment, each of the upper and lower pad members $\mathbf{14}_1$, $\mathbf{14}_3$ is allowed a significant degree of freedom of movement relative to the base 12, including movement away from the base 12. This may allow the arm protector 10 to better fit on the player's arm, reduce resistance to bending of the player's arm, and/or increase breathability or ventilation of the player's arm and the arm protector 10 itself.

More particularly, in this embodiment, each pad member $\mathbf{14}_y$ of the upper and lower pad members $\mathbf{14}_1$, $\mathbf{14}_3$ includes lateral portions $\mathbf{66}_1$, $\mathbf{66}_2$ that are movable relative to the base 12. The lateral portion $\mathbf{66}_1$ extends from the longitudinal end $\mathbf{63}_1$ of the pad member $\mathbf{14}_y$ and the lateral portion $\mathbf{66}_2$ extends from the longitudinal end $\mathbf{63}_2$ of the pad member $\mathbf{14}_y$. Each of the lateral portions $\mathbf{66}_1$, $\mathbf{66}_2$ corresponds to a substantial part of the length L of the pad member $\mathbf{14}_y$. For example, in some embodiments, a given one of the lateral portions $\mathbf{66}_1$, $\mathbf{66}_2$ may correspond to at least one-third of the length L of the pad member $\mathbf{14}_y$, in some cases at least half of the length L of the pad member $\mathbf{14}_y$, in some cases at least three-fifths of the length L of the pad member $\mathbf{14}_y$, and in some cases an even greater portion of the length L of the pad member $\mathbf{14}_y$. In this embodiment, each of the lateral portions $\mathbf{66}_1$, $\mathbf{66}_2$ of the pad member $\mathbf{14}_y$ corresponds to approximately 48% of the length L of the pad member $\mathbf{14}_y$, respectively.

Figure 6:
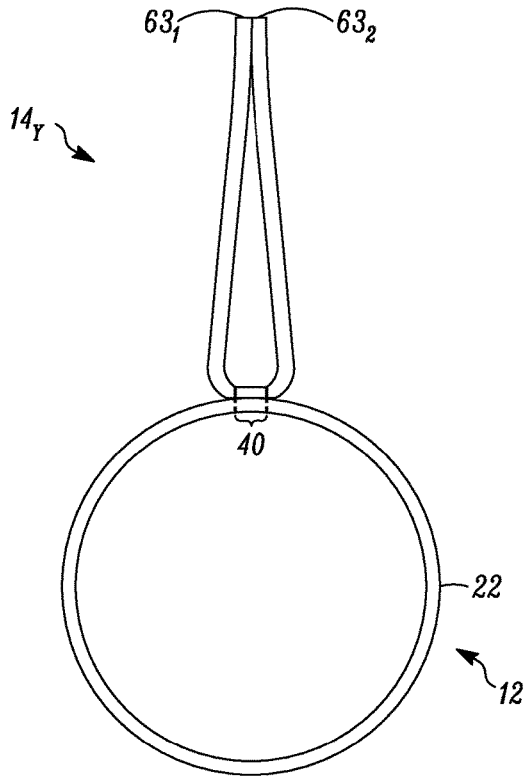
FIG. 6 shows longitudinal ends of the pad member moved in contact with one another.

In order to be movable relative to the base 12, in this embodiment, each of the lateral portions $\mathbf{66}_1$, $\mathbf{66}_2$ of the pad member $\mathbf{14}_y$ is free of fastening to the base 12 (i.e., does not include any fastener fastening that lateral portion of the pad member $\mathbf{14}_y$ to the base 12). Each of the lateral portions $\mathbf{66}_1$, $\mathbf{66}_2$ can thus freely move relative to the base 12. For instance, in this embodiment, when the arm protector 10 is worn on the player's arm, the longitudinal ends $\mathbf{63}_1$, $\mathbf{63}_2$ of the pad member $\mathbf{14}_y$ are movable adjacent to one another, as shown in FIG. 6. More particularly, in this example, when the arm protector 10 is worn on the player's arm, the longitudinal ends $\mathbf{63}_1$, $\mathbf{63}_2$ of the pad member $\mathbf{14}_y$ are movable to contact one another.

In this embodiment, the pad member $\mathbf{14}_y$ comprises a central portion 68 between its lateral portions $\mathbf{66}_1$, $\mathbf{66}_2$ that includes the fasteners $\mathbf{50}_1$, $\mathbf{50}_2$ fastening the pad member $\mathbf{14}_y$ to the base 12. More particularly, in this example, the central portion 68 is stitched to the sleeve 22 by the stitching 52 of each of the fasteners $\mathbf{50}_1$, $\mathbf{50}_2$.

As the lateral portions $\mathbf{66}_1$, $\mathbf{66}_2$ of the pad member $\mathbf{14}_y$ which are free of fastening to the base 12 to move freely relative to the base 12 correspond to substantial parts of the length L of the pad member $\mathbf{14}_y$, in this embodiment, the fastening zone 40 of the pad member $\mathbf{14}_y$ is "narrow". That is, the fastening zone 40 of the pad member $\mathbf{14}_y$ is of small extent compared to the length L of the pad member $\mathbf{14}_y$. In other words, the dimension F of the fastening zone 40 of the pad member $\mathbf{14}_y$ is considerably less than the length L of the pad member $\mathbf{14}_y$. For example, in some embodiments, the fastening zone 40 of the pad member $\mathbf{14}_y$ may span less than half of the length L of the pad member $\mathbf{14}_y$, in some cases no more than one-third of the length L of the pad member $\mathbf{14}_y$, in some cases no more than one-quarter of the length L of the pad member $\mathbf{14}_y$, in some cases no more than one-fifth of the length L of the pad member $\mathbf{14}_y$, in some cases no more than one-tenth of the length L of the pad member $\mathbf{14}_y$, in some cases no more than one-twentieth of the length L of the pad member $\mathbf{14}_y$, and in some cases an even smaller portion of the length L of the pad member $\mathbf{14}_y$.

The pad member $\mathbf{14}_y$ being movable relative to the base 12 may provide certain benefits. For example, the pad member $\mathbf{14}_y$ may allow a greater mobility of the player's arm. More specifically, the player's arm may be less constrained since its positioning is not limited by the lateral portions $\mathbf{66}_1$, $\mathbf{66}_2$ of the pad member $\mathbf{14}_y$ which can move as the player's arm moves, thereby allowing the arm protector 10 to present less resistance to bending of the player's arm. In addition, an improved breathability or ventilation of the player's arm and the arm protector 10 itself may be achieved since the lateral portions $66_1$, $66_2$ of the pad member $14_y$ do not have to be constantly pressed against the base 12. For example, when the player is not playing (e.g., on sidelines or between quarters, halves or periods), the straps $20_1$, $20_2$ can be detached such that the lateral portions $66_1$, $66_2$ of the pad member $14_y$ can move away from the base 12, thus allowing more air circulation around the base 12 and, therefore, the player's arm. Also, when the base 12 is moist from the player's sweat, ventilation may be more easily achieved since the lateral portions $66_1$, $66_2$ of the pad member $14_y$ are not permanently in contact with the base 12. For instance, once the player removes the arm protector 10, the base 12 may be more open to ventilation, allowing an increased surface area of the base 12 to be exposed to air.

In this embodiment, the intermediate pad member $14_2$ is mounted to the base 12 differently than the upper and lower pad members $14_1$, $14_3$. More particularly, in this embodiment, the intermediate pad member $14_2$ is fastened to the base 12 adjacent to its longitudinal ends $63_1$, $63_2$ by the fasteners $50_1$, $50_2$ and adjacent to its top and bottom regions by the fasteners $50_3$, $50_4$. In contrast to the upper and lower pad members $14_1$, $14_3$, the fastening zone 40 of the intermediate pad member $14_2$ is not narrow but is rather large, spanning most, in this case, substantially an entirety of the length L of the intermediate pad member $14_2$. Thus, in this embodiment, the dimension F of the fastening zone 40 of the intermediate pad member $14_2$ corresponds to substantially all of the length L of the intermediate pad member $14_2$. As such, the fastening zone 40 of the intermediate pad member $14_2$ is considerably larger than the fastening zone 40 of the upper and lower pad members $14_1$, $14_3$.

The straps $20_1$, $20_2$ help to further secure the arm protector 10 to the player's arm. More particularly, in this embodiment, the straps $20_1$, $20_2$ allow the upper and lower pad members $14_1$, $14_3$ to be retained in a bent configuration folded upon the base 12. In order to achieve this, in this example, the arm protector 10 comprises connectors $21_1$ and $21_2$ to respectively connect a free end portion of a strap $20_y$ to a pad member $14_y$ of the upper and lower pad members $14_1$, $14_3$. Each connector $21_y$ comprises a connecting element $70_1$ on the strap $20_y$ and a connecting element $70_2$ on the pad member $14_y$ that are engageable with one another to interconnect the free end portion of the strap $20_y$ to the pad member $14_y$. In this embodiment, each of the connectors $21_1$, $21_2$ comprises a hook-and-loop connector, with respective ones of its connecting elements $70_1$, $70_2$ being hook elements and loop elements. In other embodiments, the connectors $21_1$, $21_2$ may comprise snap buttons or any other suitable type of connector.

The arm protector 10 may be configured in various other ways in other embodiments.

Figure 8A:
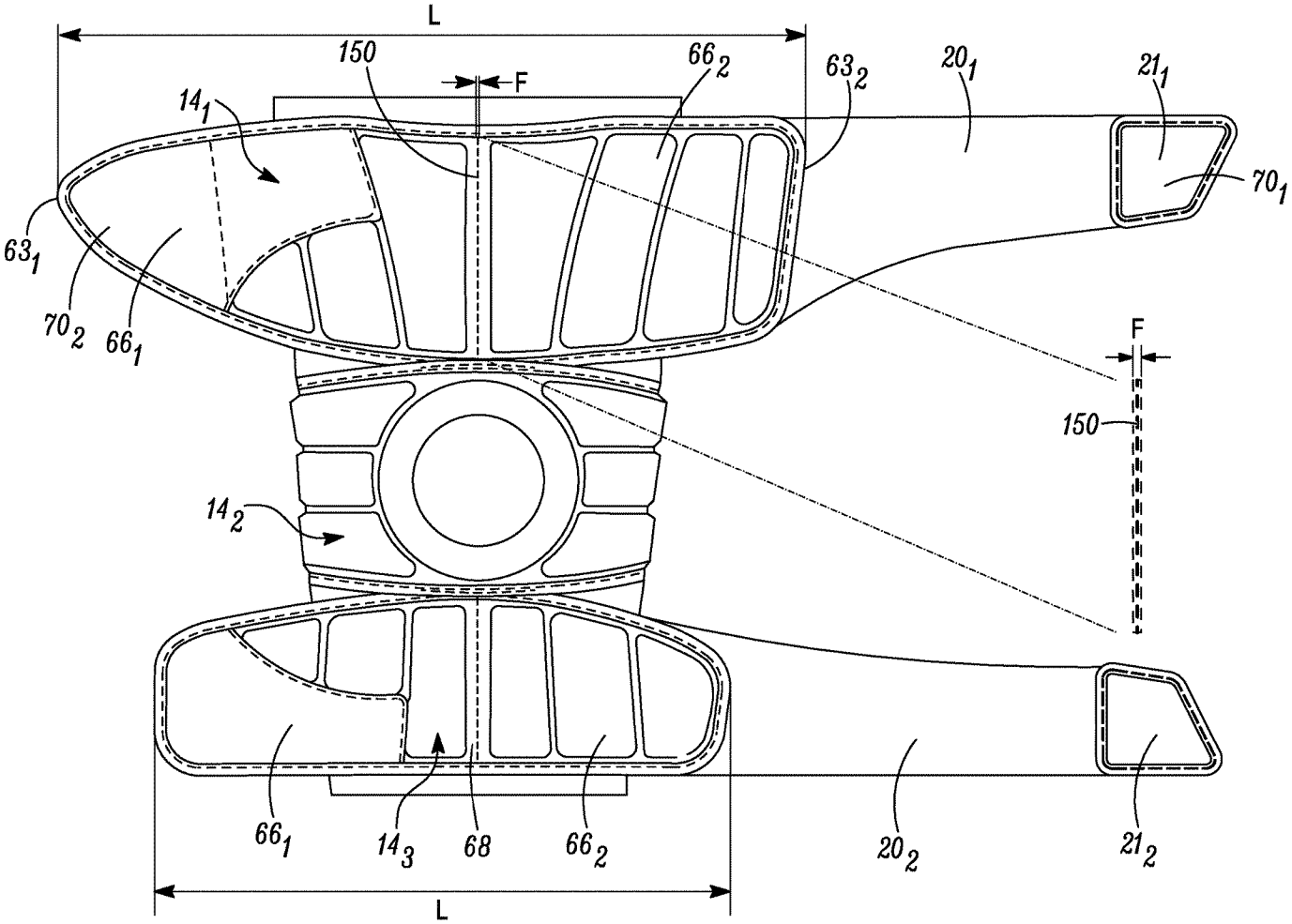
FIGS. 8A and 8B show variants of fastening of the pad member to the base.
Figure 8B:
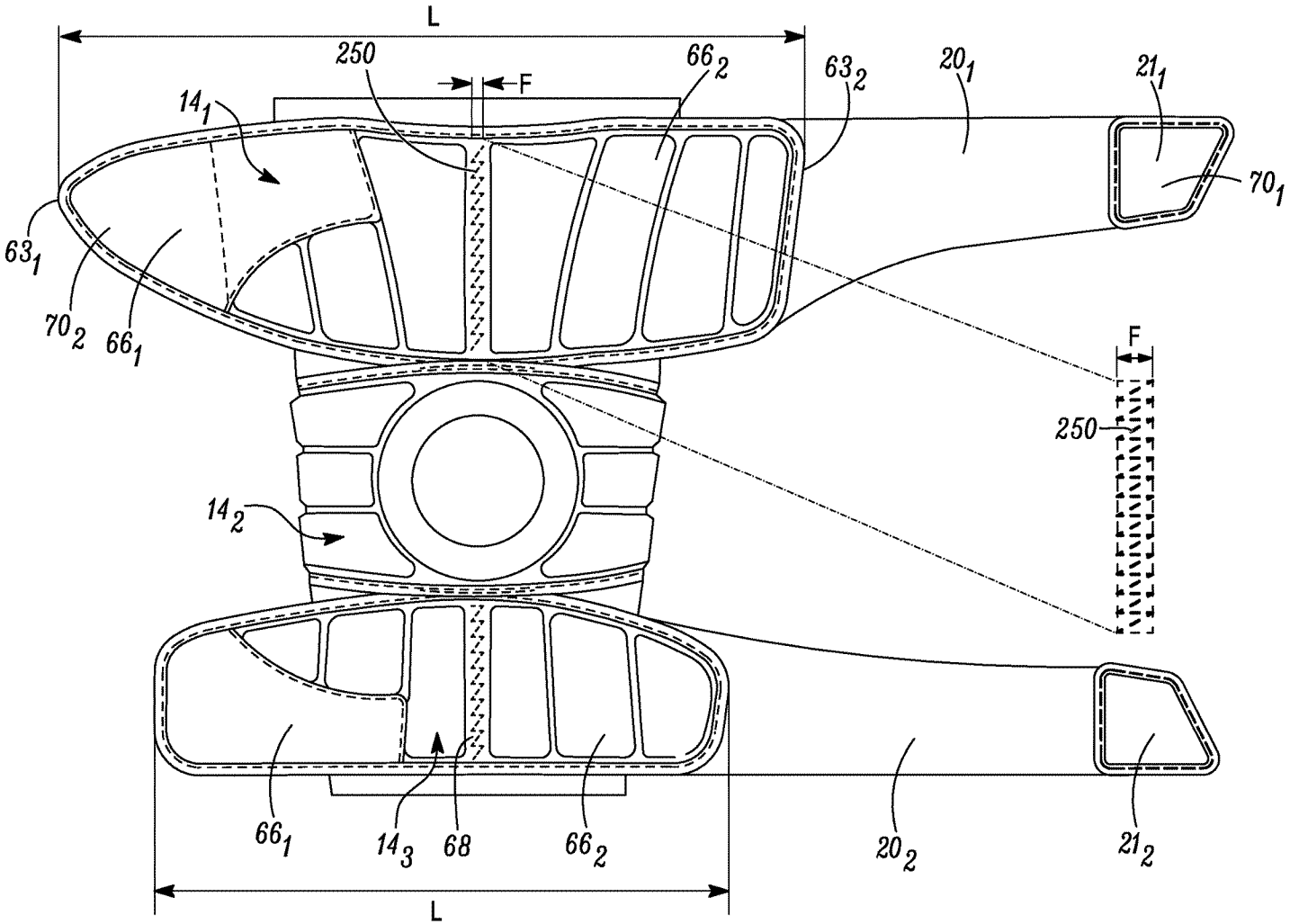

For example, in other embodiments, the fastening zone 40 of each pad member $14_y$ of the upper and lower pad members $14_1$, $14_3$ may include any number of fasteners fastening the pad member $14_4$ to the base 12 arranged in any suitable configuration. For instance, in some embodiments, the fastening zone 40 of the pad member $14_y$ may include a single (i.e., only one) fastener, such as a single stitching, which may be, for example, a straight-line stitching 150 as shown in FIG. 8A, a zigzag stitching 250 as shown in FIG. 8B, or any other stitching.

Figure 9A:
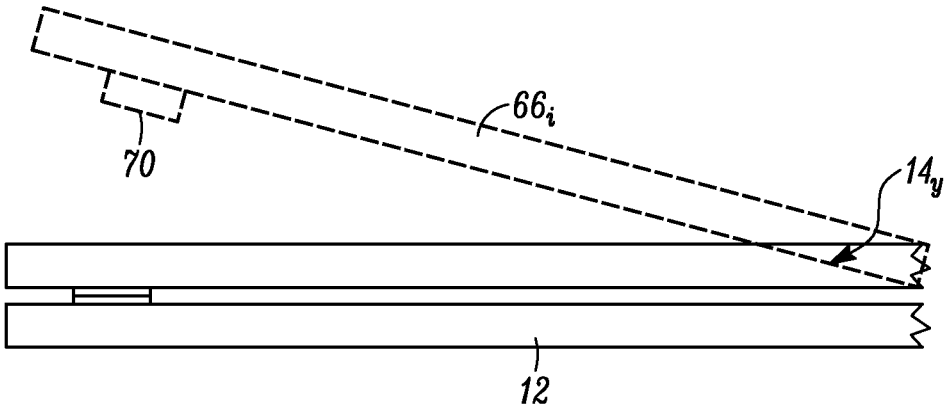
FIG. 9A shows a variant of the protector wherein a detachable fastener fastens the pad member to the base.
Figure 9B:
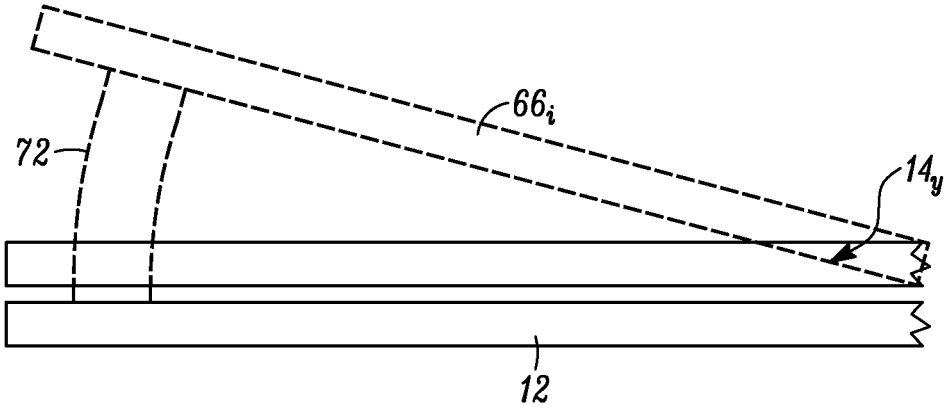
FIG. 9B shows another variant of the protector wherein a stretchable fastener fastens the pad member to the base.

As another example, in other embodiments, instead of being free of fastening to the base 12, a lateral portion $66_i$ of the lateral portions $66_1$, $66_2$ of each pad member $14_y$ of the upper and lower pad members $14_1$, $14_3$ may comprise a fastener that fastens the lateral portion $66_i$ to the base 12 but allows the lateral portion $66_i$ to move relative to the base 12. For example, in some embodiments, as shown in FIG. 9A, the lateral portion $66_i$ of the pad member $14_y$ may comprise a detachable fastener 70 that detachably fastens the lateral portion $66_i$ to the base 12, i.e., that is operable to selectively fasten the lateral portion $66_i$ to the base 12 and unfasten the lateral portion $66_i$ from the base 12. For instance, the detachable fastener 70 may include a button, clip, etc. As another example, as shown in FIG. 9B, the lateral portion $66_i$ of the pad member $14_y$ may comprise a stretchable fastener 72 that can elastically stretch to allow the lateral portion $66_i$ of the pad member $14_y$ to move relative to the base 12. For instance, the stretchable fastener 72 may comprise an elastic band, strap, etc.

Although in this embodiment the protector 10 is an arm protector for protecting a wearer's arm, in other embodiments, a protector constructed using principles described herein in respect of the protector 10 may be another type of protector to protect another limb or other body part of a wearer. For example, in other embodiments, a leg protector (e.g., sometimes referred to as a leg pad or a shin guard) for protecting a wearer's leg may be constructed using principles described herein in respect of the protector 10.

While in this embodiment the protector 10 is for a player playing lacrosse, in other embodiments, a protector constructed using principles described herein in respect of the protector 10 may be another type of protector for a player playing another type of sport, such as another type of contact sport (sometimes referred to as "full-contact sport" or "collision sport") in which there are significant impact forces on the player due to player-to-player and/or player-to-object contact. For example, in other embodiments, a protector constructed using principles described herein in respect of the protector 10 may be a hockey protector (e.g., a hockey elbow pad or a hockey leg pad) for a hockey player. As another example, in other embodiments, a protector constructed using principles described herein may be a baseball or softball protector (e.g., a batter's elbow pad or catcher's leg guard) for a baseball or softball player. As yet another example, in other embodiments, a protector constructed using principles described herein may be a soccer protector (e.g., a soccer leg guard) for a soccer player.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. An arm protector for protecting an arm of a wearer playing a contact sport, the arm protector comprising:

a base for extending at least partially around and engaging the wearer's arm;

a pad member having a first longitudinal end and a second longitudinal end opposite the first longitudinal end and comprising protective padding, the pad member providing greater impact protection than the base, the pad member being fastened to an area of the base by a fastening zone intermediate the first longitudinal end and the second longitudinal end and spanning less than half of a length of the pad member between the first longitudinal end and the second longitudinal end; and a strap extending from the first longitudinal end of the pad member, the strap being configured to extend over the second longitudinal end of the pad member and detachably engage a connecting element on the pad member while the pad member remains fastened to the base in the fastening zone.

2. The arm protector of claim 1, wherein the fastening zone spans no more than one-third of the length of the pad member.

3. The arm protector of claim 1, wherein the fastening zone spans no more than one-quarter of the length of the pad member.

4. The arm protector of claim 1, wherein the fastening zone spans no more than one-fifth of the length of the pad member.

5. The arm protector of claim 1, wherein the fastening zone spans no more than one-tenth of the length of the pad member.

6. The arm protector of claim 1, wherein the fastening zone spans no more than one-twentieth of the length of the pad member.

7. The arm protector of claim 1, wherein the fastening zone has a single stitch line.

8. The arm protector of claim 1, wherein the pad member comprises a first lateral portion extending between the first longitudinal end of the pad member and the fastening zone, and a second lateral portion extending between the second longitudinal end of the pad member and the fastening zone.

9. The arm protector of claim 8, wherein: the first lateral portion corresponds to at least one-third of the length of the pad member and the second lateral portion corresponds to at least one-third of the length of the pad member.

10. The arm protector of claim 1, wherein the base comprises a sleeve mountable about the wearer's arm.

11. The arm protector of claim 10, wherein the sleeve comprises a stretchable material.

12. The arm protector of claim 11, wherein the stretchable material is a stretchable fabric.

13. The arm protector of claim 12, wherein the stretchable fabric is a spandex fabric.

14. The arm protector of claim 1, wherein: the first longitudinal end of the pad member and the second longitudinal end of the pad member are movable to contact one another.

15. The arm protector of claim 1, wherein: the pad member is a first pad member; and the arm protector comprises a second pad member fastened to the base and comprising protective padding, the second pad member being fastened to the base by a fastening zone which spans less than half of a length of the second pad member.

16. The arm protector of claim 15, wherein the first pad member is an upper pad member for positioning above an elbow of the wearer's arm and the second pad member is a lower pad member for positioning below the elbow of the wearer's arm.

17. The arm protector of claim 16, comprising a third pad member for positioning over the elbow of the wearer's arm.

18. The arm protector of claim 17, wherein the third pad member is fastened to the base by a fastening zone which spans substantially all of a length of the third pad member.

19. The arm protector of claim 1, wherein the arm protector is a lacrosse arm pad.

20. The arm protector of claim 1, wherein the fastening zone comprises stitching.

21. The arm protector of claim 1, wherein a material of the base is different from a shock-absorbing material of the protective padding.

22. The arm protector of claim 21, wherein the material of the base is fabric and the shock-absorbing material of the protective padding is foam.

23. The arm protector of claim 1, wherein: the pad member is a first pad member; the arm protector comprises a second pad member separate from the first pad member, fastened to the base, and comprising protective padding; the second pad member provides greater impact protection than the base; the second pad member is fastened to the base by a fastening zone which is larger than the fastening zone of the first pad member.

24. The arm protector of claim 23, wherein the fastening zone of the second pad member spans at least a majority of a length of the second pad member.

25. The arm protector of claim 1, wherein the base is configured for extending around the wearer's arm.

26. An arm protector for protecting an arm of a wearer playing a contact sport, the arm protector comprising:

a base for extending at least partially around and engaging the wearer's arm;

a pad member having a first longitudinal end and a second longitudinal end opposite the first longitudinal end and comprising protective padding, the pad member providing greater impact protection than the base, the pad member being fastened to an area of the base intermediate the first longitudinal end and the second longitudinal end, the pad member being fastened to the base such that, when the arm protector is worn on the wearer's arm, the first longitudinal end and the second longitudinal end of the pad member are movable adjacent to one another; and a strap extending from the first longitudinal end of the pad member, the strap being configured to extend over the second longitudinal end of the pad member and detachably engage a connecting element on the pad member while the pad member remains fastened to said area of the base.

27. The arm protector of claim 26, wherein, when the arm protector is worn on the wearer's arm, the first longitudinal end and the second longitudinal end of the pad member are movable to contact one another.

28. The arm protector of claim 26, wherein the base is configured for extending around the wearer's arm.

29. An arm protector for protecting an arm of a wearer playing a contact sport, the arm protector comprising:

a sleeve mountable about the wearer's arm;

a pad member having a first longitudinal end and a second longitudinal end opposite the first longitudinal end and comprising protective padding, the pad member being stitched to the sleeve to an area of the base intermediate the first longitudinal end and the second longitudinal end, the pad member providing greater impact protection than the sleeve, the pad member being stitched to the sleeve by stitching spanning less than one-quarter of a length of the pad member, the pad member being elongated such that the length of the pad member is oriented transversally to a longitudinal axis of the arm protector, a portion of the pad member being movable relative to the sleeve; and a strap extending from the first longitudinal end of the pad member, the strap being configured to extend over the second longitudinal end of the pad member and detachably engage a connecting element on the pad member while the pad member remains fastened to said area of the base.

30. A protector for protecting a limb of a wearer playing a contact sport, the protector comprising:

a base for extending at least partially around and engaging the wearer's limb;

a pad member having a first longitudinal end and a second longitudinal end opposite the first longitudinal end and comprising protective padding, the pad member providing greater impact protection than the base, the pad member being fastened to an area of the base by a fastening zone intermediate the first longitudinal end and the second longitudinal end spanning less than half of a length of the pad member between the first longitudinal end and the second longitudinal end; and a strap extending from the first longitudinal end of the pad member, the strap being configured to extend over the second longitudinal end of the pad member and detachably engage a connecting element on the pad member while the pad member remains fastened to the base in the fastening zone.

31. A protector for protecting a limb of a wearer playing a contact sport, the protector comprising:

a base for extending at least partially around and engaging the wearer's limb;

a pad member having a first longitudinal end and a second longitudinal end opposite the first longitudinal end and comprising protective padding, the pad member providing greater impact protection than the base, the pad member being fastened to an area of the base intermediate the first longitudinal end and the second longitudinal end, the pad member being fastened such that, when the protector is worn on the wearer's limb, the first longitudinal end and the second longitudinal end of the pad member are movable adjacent to one another; and a strap extending from the first longitudinal end of the pad member, the strap being configured to extend over the second longitudinal end of the pad member and detachably engage a connecting element on the pad member while the pad member remains fastened to said area of the base.

32. A method of protecting an arm of a wearer playing a contact sport, the method comprising:

a) providing an arm protector for the wearer, the arm protector comprising:

a base for extending at least partially around and engaging the wearer's arm;

a pad member having a first longitudinal end and a second longitudinal end opposite the first longitudinal end and comprising protective padding, the pad member providing greater impact protection than the base, the pad member being fastened to an area of the base intermediate the first longitudinal end of the pad member and the second longitudinal end; and a strap extending from the first longitudinal end of the pad member, the strap being configured to extend over the second longitudinal end of the pad member and detachably engage a connecting element on the pad member while the pad member remains fastened to said area of the base;

b) causing the strap to extend over the second longitudinal end of the pad member to wrap at least partially around the wearer's arm while the base is engaging the wearer's arm and the wearer is playing the contact sport;

c) causing the strap to detachably engage the connecting element on the pad member while the pad member remains fastened to said area of the base.

* * * * *